United States Patent [19]

Terminella et al.

[11] Patent Number: 4,995,225

[45] Date of Patent: Feb. 26, 1991

[54] COMPACT FOOD TRAY FILM WRAPPING MACHINE

[75] Inventors: Frank Terminella; Manuele Terminella; William Stroud, all of Fayetteville, Ark.

[73] Assignee: Pacmac, Inc., Fayetteville, Ark.

[21] Appl. No.: 404,215

[22] Filed: Sep. 7, 1989

[51] Int. Cl.[5] ..... B65B 11/18

[52] U.S. Cl. ..... 53/556; 53/222; 53/226

[58] Field of Search ..... 53/556, 210, 220, 222, 53/226, 228, 230; 198/787

[56] References Cited

U.S. PATENT DOCUMENTS

| | | | |
|---|---|---|---|
| 3,369,646 | 2/1968 | Musser | 198/787 |
| 3,662,513 | 5/1972 | Fabbri | 53/222 |
| 3,724,643 | 4/1973 | Kohl | 198/787 |
| 4,631,903 | 12/1986 | Takamura | 53/556 X |
| 4,683,707 | 8/1987 | Koyama | 198/787 X |
| 4,730,441 | 3/1988 | Terminella | 53/226 X |
| 4,796,405 | 1/1989 | Owen | 53/556 X |

*Primary Examiner*—John Sipos

*Attorney, Agent, or Firm*—Robert R. Keegan

[57] ABSTRACT

There is disclosed an improved form of ejection and transport mechanism in a tray wrapping machine with an elevator that elevates a tray of meat or other product causing it to be wrapped on top and sides by a sheet of stretchable PVC film from a storage roll after which arms fold the edges of the film underneath the tray; the mechanism includes a pusher bar which pushes the fully wrapped tray off of the side of the tray elevating platform while the tray is constrained by a freely rotating endless hold-down belt serving to restrain and guide the tray; the tray is received from the pusher bar action onto a powered roller conveyor with rolls arranged radially along an arc of 90°; the motion of the finished tray upon exiting the roller conveyor is substantially parallel to the longitudinal axis of the tray wrapping machine defined by the direction of travel of the PVC film from the storage roll to the elevator position.

15 Claims, 4 Drawing Sheets

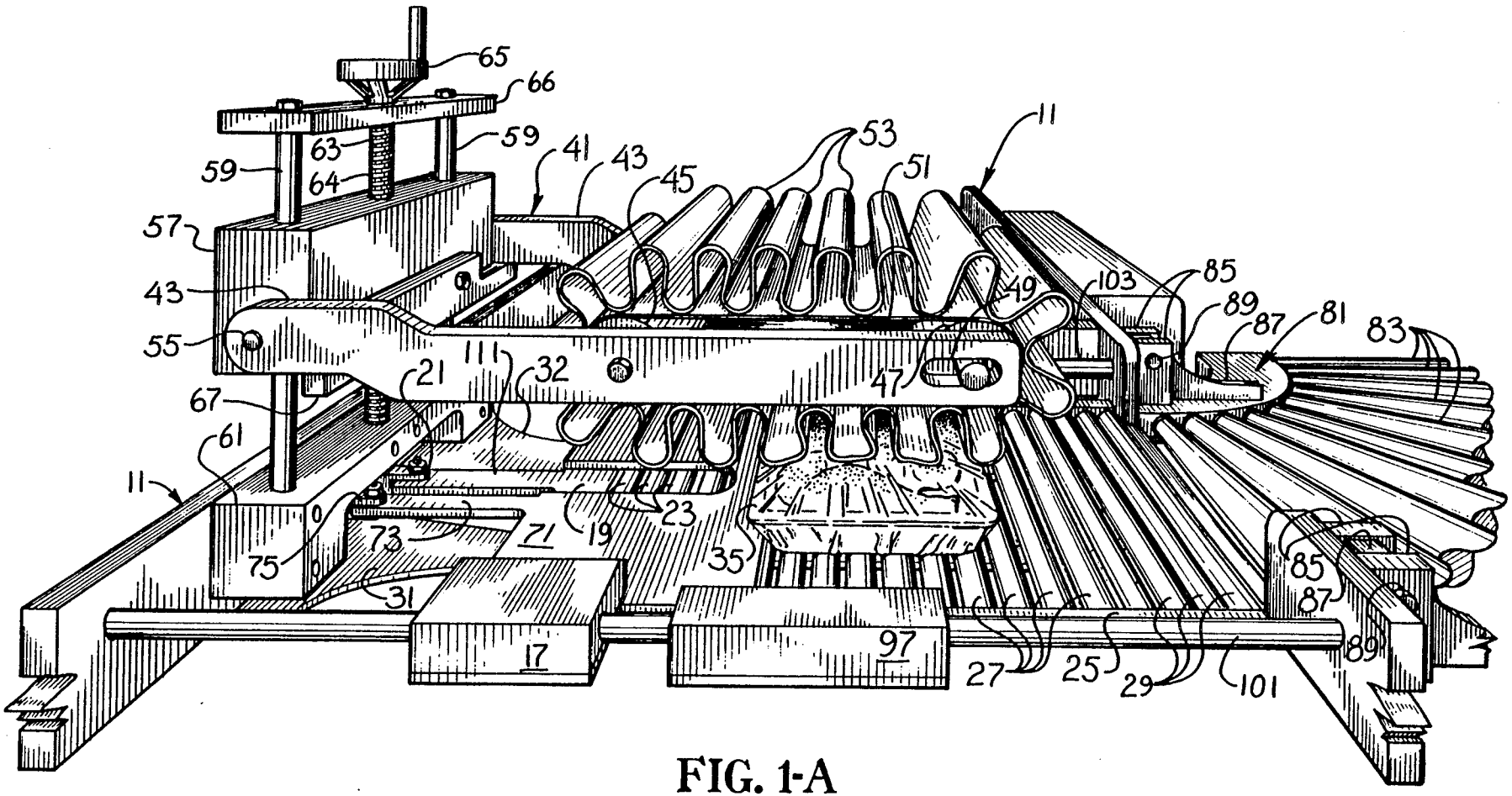
FIG. 1-A

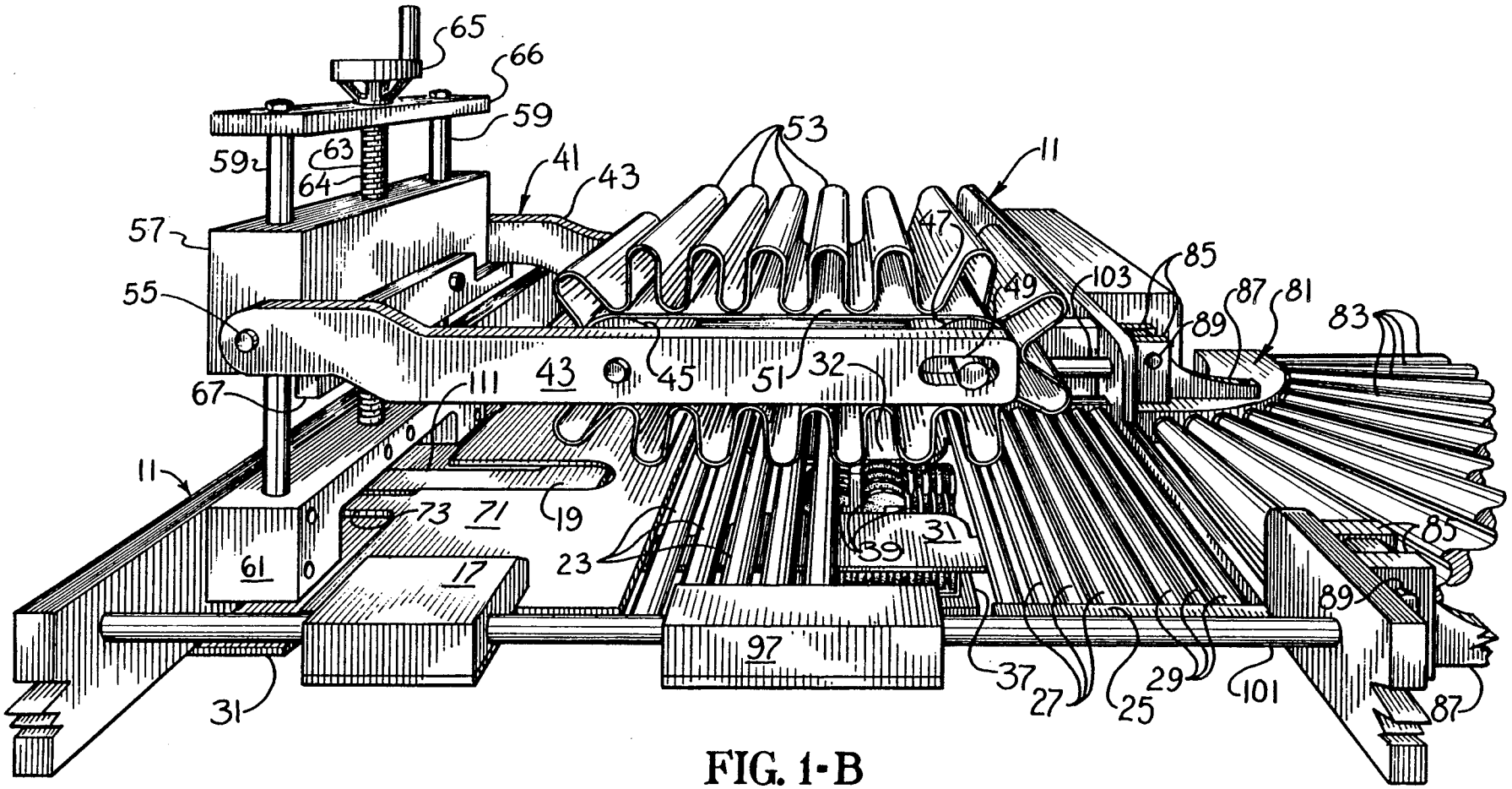
FIG. 1-B

COMPACT FOOD TRAY FILM WRAPPING MACHINE

The present invention relates to tray package wrapper machines which are commonly used to wrap trays of meat with stretchable polyvinyl chloride or similar wrapping material so that the food product is visible to the purchaser while at the same time being maintained in a sanitary condition. The film wrapped tray packages are not primarily employed as a shipping package although they may be transported when assembled in other suitable containers.

Tray package wrapping machines of this type are at least partially automated; in some cases uncovered trays containing food products are fed into the machine by hand feeding onto a conveyor which carries it into the machine where a tray is elevated to cause it to be wrapped on top and sides with stretchable film sheet from a storage roll in the machine. Thereafter the edges of the film sheet are folded under the tray from the two sides and from first one end and then the other to provide a transparent or partially transparent sanitary covering for the tray. The clinging nature of the film prevents the edges from coming loose at the bottom of the tray as it is transported out of the wrapping machine and thereafter it is commonly heated and pressed to further secure the film in place. A machine of the type described above is shown and explained in U.S. Pat. No. 4,730,441 to Terminella et al. granted Mar. 15, 1988 (U.S. Class 53/556).

According to the present invention, the travel of the tray package, particularly that part of the travel from the wrapping station to where the tray exits the machine is arranged so that the entire tray package wrapping machine can be much more compact and the space which it occupies in an assembly of machines required for the entire packaging operation is substantially less. Furthermore the operation is rendered more reliable with less likelihood of trays or tray contents being misguided or dislocated possibly requiring temporary shutdown of the packaging process.

In previous tray package wrapper machines it was common to remove the tray package from the elevator at the wrapping station by the combined action of the last actuated folding arm together with a powered endless belt or rollers riding on the top of the tray package; the belt or rollers rotate with downward pressure on the package causing it to move away from the elevator platform and onto some other form of conveyor. In these arrangements forces of the powered belt were applied primarily to the contents of the tray rather than the tray itself and performance was often unsatisfactory.

The present invention provides an improved form of ejection transport mechanism for the tray leaving the wrapping station in which the requisite forces to remove the tray from the elevator platform are applied by a pusher bar directly to the tray itself and forces applied to the tray contents are from a freely rotating endless belt serving only to hold the tray down and guide it without producing significant lateral forces on the tray contents. The pusher bar transports the tray to the edge of a powered roller conveyor having an arcuate path which smoothly turns the tray to move in a direction parallel to the longitudinal axis (axis parallel to film transport direction) of the wrapping machine by means of radially arranged powered rollers. This entire transport process is adapted to minimize any damage to or dislodgement of the wrapping film while being transported to a heat sealing station or other succeeding station in the packaging process. The heat sealing machine may be located at the exit of the arcuate path roller conveyor so that all equipment used in packaging occupies minimal floor space.

In addition to providing the features and advantages described above it is an object of the present invention to provide a food tray film wrapping machine wherein the arrangement of components, and the path provided for the food tray is caused to exit parallel to the machine longitudinal axis further allowing a compact arrangement of heat-sealing machines or other machines which may be needed to complete the packaging process.

It is another object of the present invention to provide a compact food tray film wrapping machine wherein a pusher bar removes a partially wrapped tray from the elevator platform causing the final fold of film under the tray and moving the tray to a powered roller conveyor which completes the transport of the tray from the machine to an exit point.

It is still another object of the present invention to provide such a food tray film wrapping machine having a powered roller conveyor at the tray exit portion of the machine which has frustroconical rollers arranged along the radii of an arc of approximately 90° to turn the exiting trays pushed out the side of the machine by a pusher bar to follow a path ending with a direction substantially at right angles to the direction of motion of the pusher bar.

Other objects and advantages of the invention will be apparent from consideration of the following description in conjunction with the appended drawings in which:

FIG. 1A is a perspective view of a compact food tray film wrapping machine having the improvements provided by the present invention;

FIG. 1B is a perspective view of the apparatus of FIG. 1A at a different stage of operation;

Figure 2:
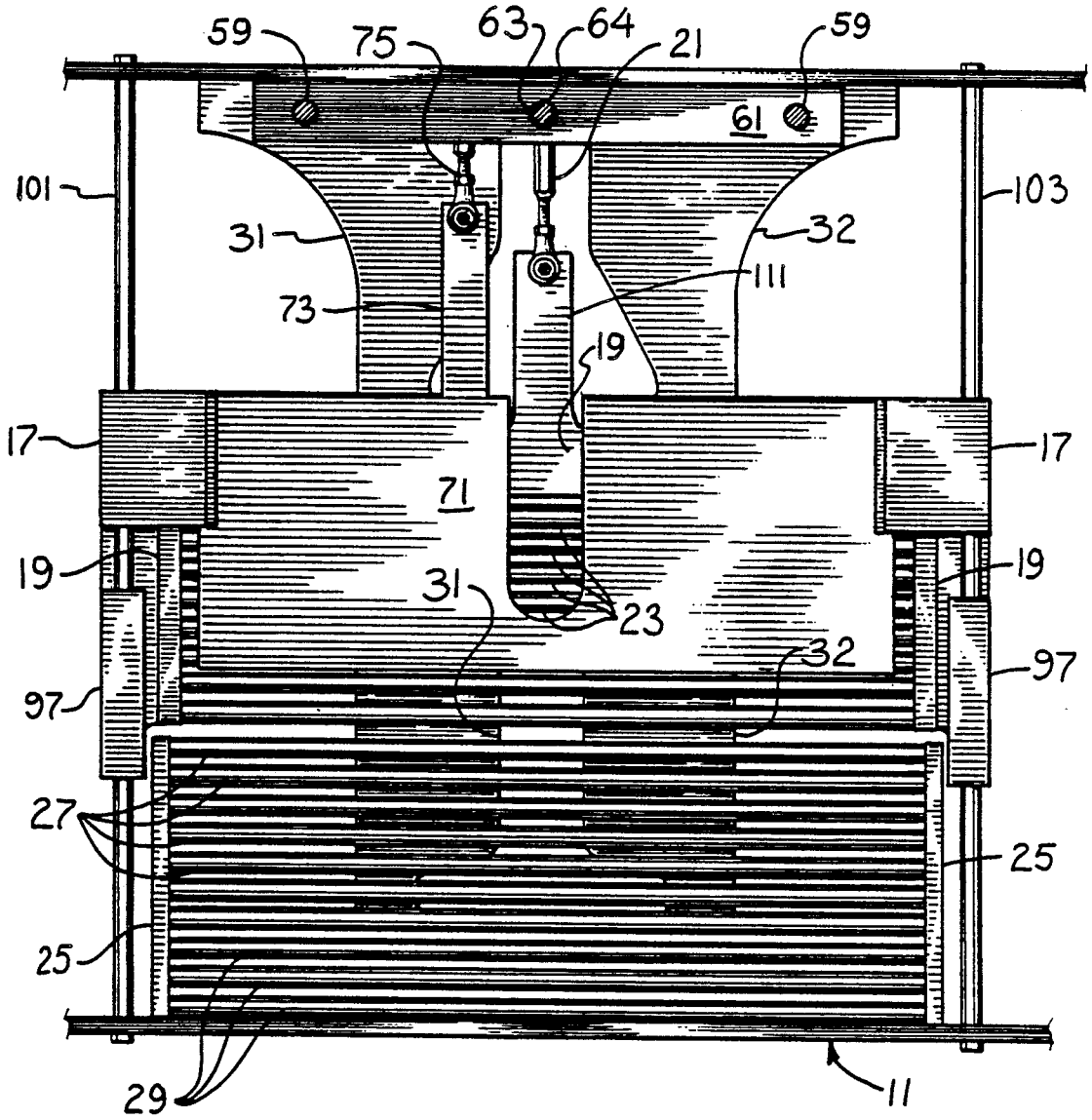
FIG. 2 is a top plan view of the apparatus of FIG. 1A.

Referring now to the drawings, and particularly FIG. 1A, a compact food tray film wrapping machine II according to the invention is shown having guide rods 101 on which are mounted sliders 17 and 97. The sliders 17 and 97 preferably engage the guide rods 101 by means of a low friction bushing or bearing (not shown).

Supported by and between sliders 97 is a rear folding plate 19 having an extended tab 111 secured to an actuating link 21. The actuating link 21 is given coordinated reciprocating movement from a cam of the wrapping machine cam array in accordance with customary practice.

Plate 19 is preferably provided with five or more freely rotating rollers 23, and it is these rollers which run along the bottom of the tray package between the tray and the platform to fold the rear fold of the film around the bottom of the tray package. After this movement tray 35 rests on rollers 23.

Although the number of rollers 23 provided for the rear folding plate 19 is somewhat greater than usual in previous similar tray wrapping machines, the operation of the rear folding plate 19 is generally conventional.

Lying in substantially the same plane as plate 19 and rollers 21 is a stationary frame 25 having mounted therein several free running rollers 27 and further powered rollers 29 at the outer end of frame 25. Rollers 29 are continuously rotated by conventional means not shown. Rollers 29 may be powered by a motor and belt drive provided specifically for that purpose, or they could be powered by belts or other drive connections to a main motor drive shaft for the machine.

As best shown in FIGS. 1B and 2, folding arms 31 and 32 are provided which are illustrated as arms of the type shown in the aforementioned Terminella et al. patent. Also shown in FIG. 1B is a conventional elevator platform 37 which lifts the food tray against the film sheet in a generally conventional manner and which is provided with fingers 39 which pivot out of the way as they are engaged by folding arm 31 or 32 or folding plate 19. The apparatus for feeding, holding, and otherwise handling the film wrap sheets may be of any suitable type such as shown in the Terminella et al. patent; such apparatus forms no part of the present invention, and it is not illustrated. It may be noted that food tray 35 is illustrated in FIG. 1A but it has been omitted in FIG. 1B to better show the elevator platform 37 and the fingers 39 together with folding arms 31 and 32.

A hold down device 41 is provided and is formed by arms 43 between which are mounted roller pulleys 45 and 47 which support wide endless belt 51. Roller pulley 47 is mounted in a slotted opening 49 with a resilient bias mechanism (not shown) urging it to the right in FIG. 1A and causing roller pulley 47 to act as an idler roller to maintain the tension on belt 51. Belt 51 may be from 6 to 12 inches wide.

Belt 51 may be provided with a serpentine web providing corrugations 53 which give the belt substantial resilience and flexibility in conforming to the shape of food products in the food trays 35; such food products are commonly non-uniform in shape, and somewhat non-uniform in size.

Arms 43 are pivotally attached by pins 55 mounted to a mounting block 57 that is slidably secured on vertical rods 59. Vertical rods 59 are mounted in a base 61 securely attached to the body of wrapping machine 11. Accordingly rods 59 are stationary and motion of block 57 is restrained to vertical motion. The height of hold-down device 41 is adjusted by raising and lowering block 57 by means of screw actuator 63 having a threaded portion 64 engaging a tapped hole in block 57. Screw actuator 63 is secured at the top in a top plate 66 attached to vertical rods 59 and is provided with a crank 65 for raising and lowering arms 43. Pivot pin 55 permits hold-down device 41 to be tilted up for access to the folding arms 31, 32, and the elevator platform portion of the machine; stop 67 is provided to maintain arms 43 in a generally horizontal position.

While the appearance of hold-down device 41 is superficially similar to apparatus of previously known machines its operation is distinctly different. In previous machines there was an endless belt overriding the food tray on the elevator platform but it was supplied with power to rotate it for pushing the wrapped tray laterally off of the elevator platform. This resulted in lateral forces being applied to the film wrap and the contents of the tray creating a substantial likelihood that the film wrap and/or the tray contents would be dislodged. In addition to producing improperly wrapped packages the powered overriding belt could create spills or mishaps requiring shut-down of the equipment. The hold-down device 41 of the present invention is not powered and the belt 51 is very freely rotating so that the only significant force applied to the contents and the tray is a downward force which will neither disturb the contents of the tray, the wrapping or otherwise interfere with &he orderly processing of the wrapped package.

In the present invention the necessary force to remove the tray from the elevator platform is provided by pusher arm 71 having an extension tab 73 connected by a link 75 to the cam mechanism of the apparatus so that it is reciprocated in a timed sequence. Generally the sequence of operation is that folding arms 31 and 32 and folding plate 19 operate in sequence and finish at about the same time whereupon the pusher bar 71 is actuated to push tray 35 off of the rear folding plate 19 and rollers 23 to a position where it is further transported by powered rollers 29 mounted in frame 25.

Figure 3:
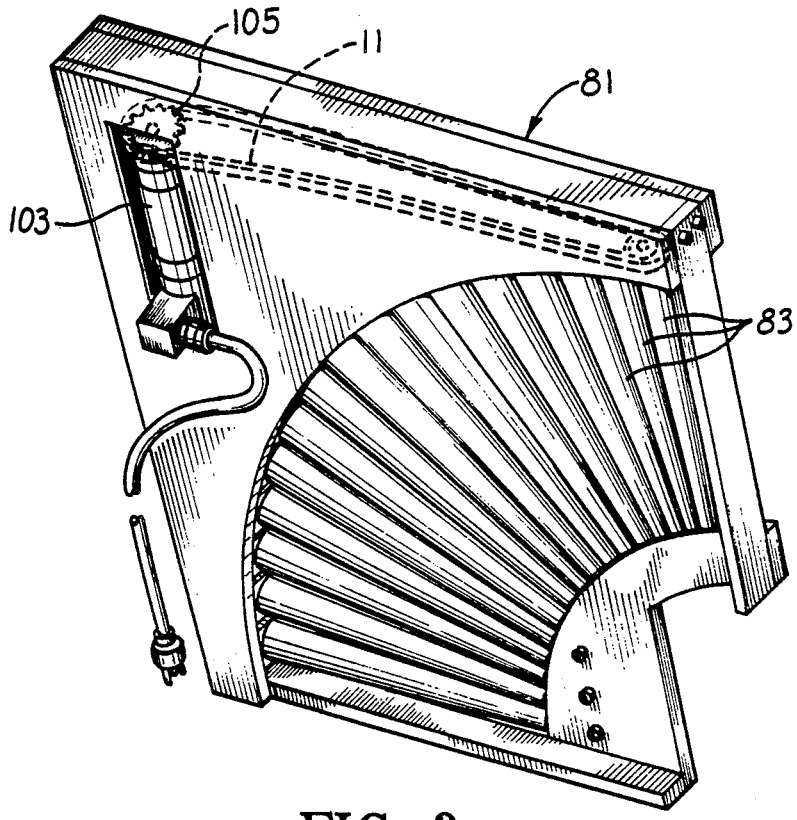
FIG. 3 is a side elevational view of the apparatus of FIG. 1A with the roller conveyor raised to show the bottom thereof.
Figure 4:
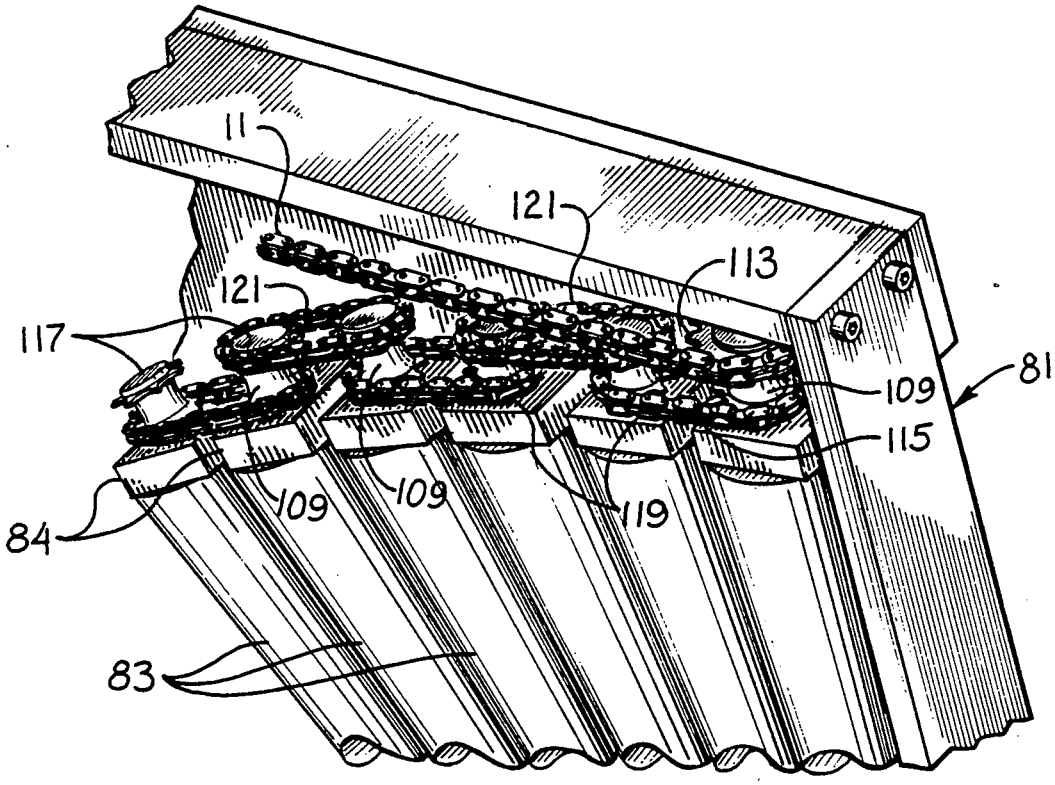
FIG. 4 is an enlarged detailed view of the apparatus of FIG. 3 particularly showing the chain drive mechanism for the rollers of the roller conveyor.

Trays 35 transported by powered rollers 29 are received by a powered roller conveyor 81 having frustroconical rollers 83 arrayed in an arc of about 90°. Rollers 83 are rotatably mounted in bearing blocks 84. The details of the powered roller conveyor are best shown in FIGS. 3 and 4 which show the powered roller conveyor tilted to an upright position. The tilt capability of the powered roller conveyor 81 is provided by brackets 85 and 87 on the film wrapping machine 11 and on the powered roller conveyor 81 respectively, together with a hinge pin 89 serving as a pivot for tilting powered roller conveyor 81. Such tilting of the powered roller conveyor is desirable to give ready access to the front lower portion of the machine for maintenance or for other purposes. The powered roller conveyor 81 may be removed from the film wrapping machine 11 if for any reason it is desired to have film wrap trays 35 transported straight off the end of frame 25 without being turned through 90° as is done by the powered roller conveyor 81.

Referring to FIGS. 3 and 4, the rollers 83 are powered by a separate electric motor 103 provided for that purpose. It is acceptable for the rollers 83 to operate continuously at a constant speed when the machine is on, but a variable speed motor and suitable controls could be provided if desired.

In the embodiment illustrated all of the rollers 83 are powered, although less than all of the rollers could be powered if desired; for example every other roller could be free turning with only half of the rollers powered. Power is transmitted to the rollers from motor 103 by a sprocket 105 on the motor; the motor sprocket 105 engages a chain belt 11 which in turn engages sprocket 113 mounted on the shaft 109 of the right-most one of rollers 83 thereby causing it to rotate at substantially the same speed as sprocket 105. The speed of sprocket 105 may be about one hundred or a few hundred revolutions per minute. Any reduction gearing required to provide this rotational speed will of course be provided for the motor 103.

There is an inner sprocket 115 in addition to the sprocket 113 on shaft 109, and there is a similar inner sprocket 115 on each of the shafts 109 of the other rollers 83. All the other rollers 83 also have outer sprockets 117 on their shafts 109. As best shown in FIG. 4, starting from the right the first and second rollers 83 are coupled together by a short chain belt 119 engaging respective inner sprockets 115. The same arrangement is provided for the third and fourth, the fifth and sixth, and following such pairs of rollers 83.

Again counting from the right the second and third rollers 83 are coupled together by a short chain belt 121 linking outer sprockets 117, and the same arrangement is provided with respect to the fourth and fifth, the sixth and seventh, and similar pairs of rollers.

It will thus be seen that all of the rollers are coupled for rotational motion at the same rate as the rightmost roller 83 which is driven by motor 103. The arrangement shown arbitrarily has the rightmost roller 83(which is the last roller to receive a tray 35) to be the one which is directly driven by the motor. Obviously the roller on the opposite end of the conveyor or any roller intermediate thereof could be the directly driven roller. Some rollers may turn at a different rate if desired.

As illustrated, the rollers 83 have maximum diameters which are two to three times as great as their minimum diameters, and this causes the tray to be rotated through about 90° as its path also curves through about 90° along roller conveyor 81, roller conveyor 81 brings the path of the trays 35 transported out of the film wrapping machine 11 to a direction parallel to the longitudinal axis of the film wrapping machine 11 and very close to it so that a heat sealing machine or all equipment needed to complete the packaging process can be located in a very compact assembly taking up relatively little floor space. At the same time various parts of the film wrapping machine to which access is required are readily accessible by lifting the powered roller conveyor 81 to a position shown in FIG. 3 or by tilting hold-down device 41 up and around the pivotal axis provided by pins 55.

The overall operation of the apparatus is believed to be generally apparent from the previous description but it will be briefly summarized as follows:

An unwrapped tray is lifted by elevator platform 37 while resting on fingers 39 in a manner described in U.S. Pat. No. 4,730,441 or in any suitable manner, at which time folding arms 31 and 32 close to wrap the tray with film edges folded underneath; a moment later folding plate 19 slides along rods 101 and 103 to make an underwrap from the rear.

After three wrapping folds described above the pusher bar 71 pushes the tray 35 (to the right in FIG. 1A) whereupon the tray 35 passes on to rollers 23 and the fourth fold of film is made under the tray. After pusher bar 71 has reached the end of its travel, tray 35 is further transported by powered rollers 29 onto powered roller conveyor 81. It is then transported in an arc of about 90° while it is simultaneously turned through about 90° causing it now to be moving in a direction parallel to the longitudinal axis of film wrapping machine 11. Trays will then be picked up by further apparatus (not shown) to complete any further processing required in the packaging operation or to transport the trays to some other subsequent destination.

Although several variations and modifications to the invention have been illustrated, described or suggested above, other modifications and variations will be apparent to those skilled in the art, and accordingly the scope of the invention is not to be considered limited to the particular embodiments or variations described or suggested but is rather to be determined by reference to the appended claims.

What is claimed is:

1. In a food tray film wrapping machine having a wrapping station and having film folding arms to fold edges of the film under the tray at said wrapping station, the improvement comprising a powered conveyor for receiving said trays from one side of said wrapping station and moving them along a path with a predetermined final direction of travel, a tray pusher bar and means for actuating said pusher bar following the operation of said folding arms to push a tray from said wrapping station at right angles to said final direction of travel onto said conveyor, and an endless belt looped around two freely rotatable end rollers and means for mounting said belt and rollers above said wrapping station with said belt extending in a direction transverse to said final direction of travel and with partially restrained freedom of vertical movement of said belt thereby causing it to exert downward force on a tray being displaced from said wrapping station by said pusher bar while rotated only by motion of said tray.

2. Apparatus as recited in claim 1 wherein said conveyor comprises at least six rollers arranged radially along a 90° arc, each said roller being of frustroconical shape with its maximum diameter being at least approximately three times its minimum diameter.

3. Apparatus as recited in claim 2 wherein said pusher bar is elongated in a directed parallel to the longitudinal axis of said machine and includes means at each end thereof for slideably mounting said pusher bar on rods extending at right angles to said final direction of travel.

4. Apparatus as recited in claim 1 further including a plurality of elongated rollers arranged substantially parallel to and slightly below the vertical level of said pusher bar and located at the edge of said wrapping station and adapted to receive the bottom surface of said trays and provide a low-friction support therefor.

5. In a food tray film wrapping machine having an electric motor driving means, an elevator platform for lifting a tray against a film sheet being fed along the longitudinal axis of said machine and film folding arms to fold edges of the film under the tray, the improvement comprising a horizontal roller conveyor with at least six rollers arranged radially along a 90 degree arc to provide a conveyor for receiving said trays from one side of said elevator platform and moving them through an arcuate path of 90 degrees with a final direction of travel parallel to said longitudinal axis, an electric motor separate from said electric motor driving means for rotating a first one of said rollers and means for driving each successive one of said rollers from a previous roller, a tray pusher bar and means for actuating said pusher bar after operation of said folding arms to push a tray from said elevator platform at right angles to said longitudinal axis to front edge of said roller conveyor, and a wide endless belt looped around two freely rotatable and rollers and at least one other idler roller and means for mounting said belt and rollers above said platform with said belt extending toward the direction of said roller conveyor and with partially restrained freedom of vertical movement causing said belt to be rotated by only motion of and by contact with a tray being displaced from said elevator platform by said pusher bar.

6. Apparatus as recited in claim 5 wherein each roller of said conveyor is of frustroconical shape with its maximum diameter being at least approximately three times its minimum diameter.

7. Apparatus as recited in claim 5 wherein said pusher bar is elongated in a direction parallel to the longitudinal axis of said machine and includes means at each end thereof for slideably mounting said pusher bar on rods extending at right angles to the longitudinal axis of said machine.

8. Apparatus as recited in claim 5 further including a plurality of elongated rollers arranged substantially parallel to and slightly below the vertical level of said pusher bar and located at the edge of said elevator platform and adapted to receive the bottom surface of said trays and provide a low-friction support therefor.

9. Apparatus as recited in claim 6 further including a powered cylindrical roller conveyor between said elevator platform and the nearest frustoconical roller of said roller conveyor.

10. Apparatus as recited in claim 6 wherein said horizontal roller conveyor is pivotally mounted about a horizontal axis parallel to said longitudinal axis and is capable of being raised to a vertical position.

11. Apparatus as recited in claim 9 wherein said pusher bar is elongated in a direction parallel to the longitudinal axis of said machine and includes means at each end thereof for slideably mounting said pusher bar on rods extending at right angles to said final direction of travel of said machine.

12. In a food tray film wrapping machine having an electric motor driving means, an elevator platform for lifting a tray against a film sheet being fed along the longitudinal axis of said machine and side and rear film folding arms to fold edges of the film under the tray, the improvement comprising a horizontal roller conveyor with at least six frustoconical rollers arranged radially along a 90 degree arc to provide a conveyor for receiving said trays from one side of said elevator platform and moving them through an arcuate path of 90 degrees with a final direction of travel parallel to said longitudinal axis, each frustoconical roller of said horizontal roller conveyor maximum diameter being at least approximately three times its minimum diameter, an electric motor separate from said electric motor driving means for rotating a first one of said rollers and means for driving each successive one of said rollers from a previous roller, a tray pusher bar elongated in a direction parallel to the longitudinal axis of said machine including means at each end for slideably mounting said pusher bar on rods extending at right angles to the longitudinal axis of said machine, means for actuating said pusher bar after operation of said folding arms to push a tray from said elevator platform at right angles to said longitudinal axis to the front edge of said roller conveyor, and a wide endless belt looped around two freely rotatable end rollers and at least one other idler roller and means for mounting said belt and rollers above said platform with said belt extending toward the direction of said roller conveyor and with partially restrained freedom of vertical movement causing said belt to be rotated by only motion of and by contact with a tray being displaced from said elevator platform by said pusher bar.

13. Apparatus as recited in claim 12 further including a plurality of elongated rollers arranged substantially parallel to and slightly below the vertical level of said pusher bar and located at the edge of said elevator platform and adapted to receive the bottom surface of said trays and provide a low-friction support therefor.

14. Apparatus as recited in claim 12 further including a powered cylindrical-roller conveyor between said elevator platform and the first frustoconical roller of said horizontal roller conveyor.

15. Apparatus as recited in claim 12 wherein said horizontal roller conveyor is pivotally mounted about a horizontal axis parallel to said longitudinal axis and capable of being raised to a vertical position.

* * * * *

UNITED STATES PATENT AND TRADEMARK OFFICE

CERTIFICATE OF CORRECTION

PATENT NO. : 4,995,225

DATED : February 26, 1991

INVENTOR(S) : Terminella et al.

It is certified that error appears in the above-identified patent and that said Letters Patent is hereby corrected as shown below:

On the Title Page, Items [19] and [75] change "Manuele" to --Emanuele--.

In Column 6, line 29 (claim 3) change "directed" to --direction--.

In Column 6, line 32 (claim 3) after "travel" insert --of said machine.--

In Column 6, line 58 (claim 5) after "to" insert --the--.

In Column 6, line 61 (claim 5) change "and" to --end--.

Signed and Sealed this

Twenty-ninth Day of December, 1992

*Attest:*

DOUGLAS B. COMER

*Attesting Officer*

*Acting Commissioner of Patents and Trademarks*